US012044222B2

(12) United States Patent
Arnold et al.

(10) Patent No.: US 12,044,222 B2
(45) Date of Patent: Jul. 23, 2024

(54) METERING PUMP WITH TEMPORARY REVERSAL OF DIRECTION OF THE DISPLACEMENT ELEMENT

(71) Applicant: ProMinent GmbH, Heidelberg (DE)

(72) Inventors: Christian Arnold, Weinheim (DE); Martin Reinhard, Heidelberg (DE)

(73) Assignee: ProMinent GmbH, Heidelberg (DE)

( * ) Notice: Subject to any disclaimer, the term of this patent is extended or adjusted under 35 U.S.C. 154(b) by 0 days.

(21) Appl. No.: 17/584,529

(22) Filed: Jan. 26, 2022

(65) Prior Publication Data

US 2022/0243709 A1 Aug. 4, 2022

(30) Foreign Application Priority Data

Feb. 4, 2021 (DE) ..... 10 2021 102 664.4

(51) Int. Cl.
*F04B 13/00* (2006.01)
*F04B 49/12* (2006.01)

(52) U.S. Cl.
CPC ..... *F04B 13/00* (2013.01); *F04B 49/12* (2013.01); *F04B 2205/503* (2013.01)

(58) Field of Classification Search
CPC .. F04B 43/067; F04B 2205/503; F04B 49/12; F04B 13/00
See application file for complete search history.

(56) References Cited

U.S. PATENT DOCUMENTS 1,627,257 A * 5/1927 Stevens ..... F04B 43/067 417/63
4,883,409 A 11/1989 Strohmeier et al.
(Continued)

FOREIGN PATENT DOCUMENTS

DE 3785207 T2 9/1987
DE 102008061904 A1 6/2010
(Continued)

*Primary Examiner* — Thomas Fink
(74) *Attorney, Agent, or Firm* — PAUL & PAUL

(57) ABSTRACT

The present invention relates to a method for moving a fluid comprising the steps a. providing a metering head comprising a metering chamber and a displacement element which delimits said metering chamber, b. moving the displacement element in a suction direction from a first position to a second position, wherein a volume of the metering chamber in the second position of the displacement element is greater than a volume of the metering chamber in the first position of the displacement element such that fluid is drawn into the metering chamber via a fluid inlet during a suction stroke, c. moving the displacement element in a pressure direction from the second position to the first position such that fluid is forced out of the metering chamber via a fluid outlet during a pressure stroke. In order to provide a method for moving a fluid or a corresponding metering pump with which a number of the aforementioned disadvantages are prevented without the need for additional components, it is proposed according to the invention that the movement of the displacement element in suction direction during the suction stroke involve at least two changes of direction before the displacement element reaches the second position and/or that the movement of the displacement element in pressure direction during the pressure stroke involve at least two changes of direction before the displacement element reaches the first position.

20 Claims, 3 Drawing Sheets

(56) References Cited

U.S. PATENT DOCUMENTS

Figure 1:
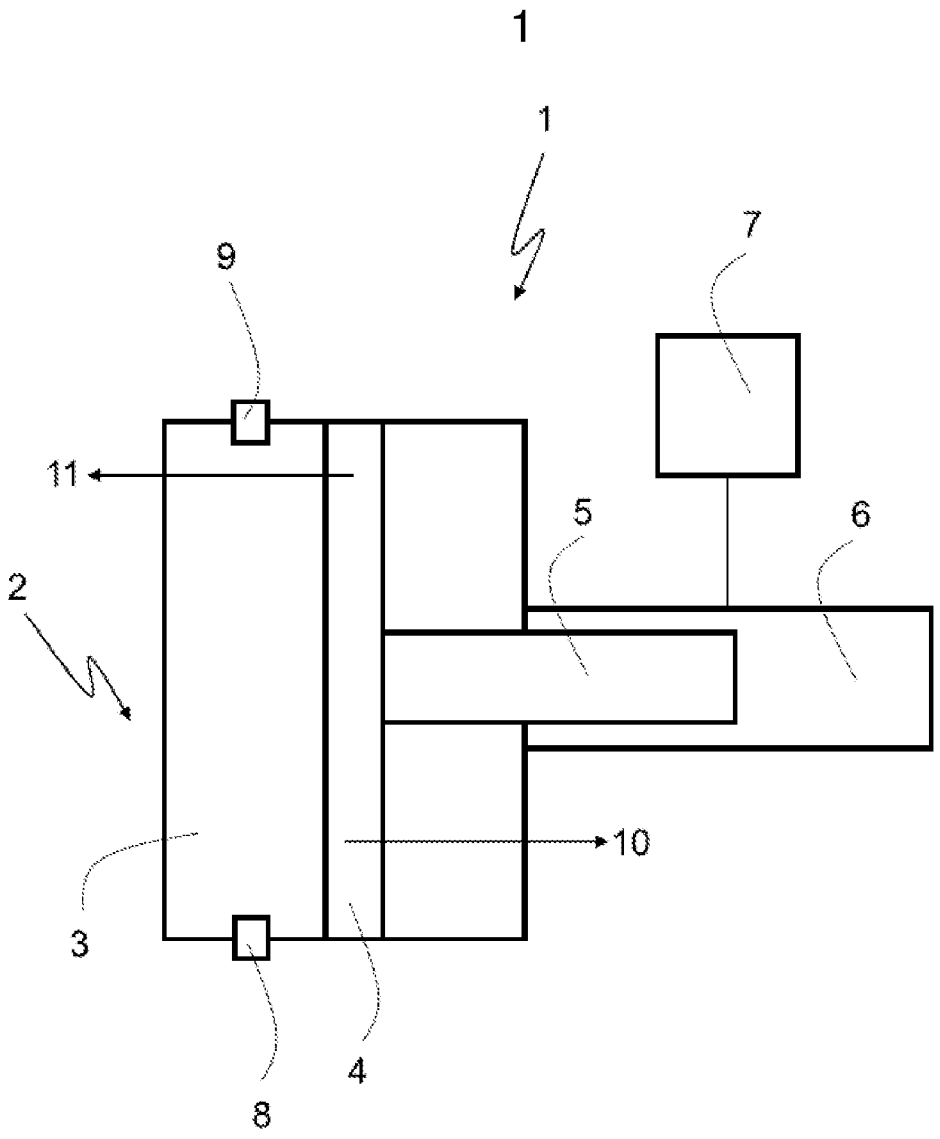

| | | | | |
|---|---|---|---|---|
| 8,540,799 | B2 * | 9/2013 | Mueller | F04B 53/06 96/155 |
| 9,057,300 | B2 | 6/2015 | Dolenec | |
| 2020/0200162 | A1 | 6/2020 | Reinhard | |

FOREIGN PATENT DOCUMENTS

| | | | |
|---|---|---|---|
| DE | 102011003912 | A1 | 8/2012 |
| DE | 102012015046 | A1 | 2/2014 |
| DE | 102016119930 | A1 | 4/2018 |
| DE | 102017008127 | B3 | 12/2018 |
| DE | 102017113724 | A1 | 12/2018 |
| DE | 102018113421 | A1 | 12/2019 |

* cited by examiner

2

METERING PUMP WITH TEMPORARY REVERSAL OF DIRECTION OF THE DISPLACEMENT ELEMENT

CROSS-REFERENCE TO RELATED APPLICATION

This application claims the priority of German Application No. 10 2021 102 664.4, filed on Feb. 4, 2021.

The present invention relates to a method for moving a fluid comprising the steps a. providing a metering head comprising a metering chamber and a displacement element which delimits said metering chamber, b. moving the displacement element in a suction direction from a first position to a second position, wherein a volume of the metering chamber in the second position of the displacement element is greater than a volume of the metering chamber in the first position of the displacement element such that fluid is drawn into the metering chamber via a fluid inlet during a suction stroke, c. moving the displacement element in a pressure direction from the second position to the first position such that fluid is forced out of the metering chamber via a fluid outlet during a pressure stroke.

The present invention further relates to a metering pump for moving a fluid, comprising a metering head, a metering chamber disposed in said metering head, and a displacement element which can be moved back and forth between a first position and a second position, wherein the displacement element delimits the metering chamber, and a volume of the metering chamber in the second position of the displacement element is greater than a volume of the metering chamber in the first position of the displacement element, wherein the displacement element is coupled to a drive via a movable element such that, in an operation of the drive, in a housing, the movable element carries out a forward stroke and a return stroke in the direction of an axis of movement having a stroke length h between a first end position and a second end position and the displacement element is moved back and forth between the first position and the second position, wherein the drive further comprises a control device.

Metering pumps and methods for moving a fluid are used in many fields of application. Examples include the treatment of drinking water with disinfectants, the metering of corrosion inhibitors and biocides in cooling circuits, the metering of flocculants in wastewater treatment, the metering of additives in the paper industry or the metering of additives in the production of plastics.

For metering a fluid, a metering head typically comprises a metering chamber into which fluid is drawn, for example from a reservoir, via a fluid inlet and fluid is forced out of the metering chamber via a fluid outlet. For this purpose, a metering pump further comprises a displacement element which can be moved back and forth between a first position and a second position and delimits the metering chamber. A volume of the metering chamber therefore changes as a result of a movement of the displacement element between the first and the second position, which affects the pressure conditions in the metering chamber and conveys the fluid.

To this end, a volume of the metering chamber in the first position is smaller than in the second position of the displacement element. Consequently, when the displacement element moves into the second position during a so-called suction stroke, the increase in volume of the metering chamber creates underpressure in the metering chamber and the fluid is drawn into the metering chamber via the fluid inlet. On the other hand, when the displacement element moves into the first position during a so-called pressure stroke, the volume of the metering chamber decreases, overpressure is created and the fluid is forced out via the fluid outlet.

The prior art also includes so-called pulsators for moving a fluid, however, which, in contrast to a metering pump, do not have a fluid inlet separate from the fluid outlet or in which a separate fluid inlet is present but closed. Here, too, the volume of the metering chamber is alternately increased and decreased in cycles, so that the pressure the fluid is being subjected to changes cyclically as well. Unlike the metering pump, however, there is no fluid transport from the fluid inlet to the fluid outlet; instead a cyclically changing pressure is produced in the working line connected to the fluid outlet. In this embodiment, the fluid outlet also functions as a fluid inlet.

A variety of different drive options for moving the displacement element are known from the prior art. A movable element of the motor can be connected directly to the displacement element, for example, and the displacement element can then be moved via a movement of the movable element. Alternatively, hydraulic drives are also known, in which a movable stroke element changes a pressure of a hydraulic fluid acting on the displacement element. For this purpose, the displacement element additionally delimits a hydraulic chamber filled with hydraulic fluid, so that the displacement element is moved as a result of the change in pressure in the hydraulic chamber.

The type of drive used usually depends on the intended application. For example, the metering of very small quantities is subject to different requirements than the metering of larger quantities, which should be carried out very quickly. For many applications, the metering profile of a metering pump, i.e. the quantity of fluid conveyed by the metering pump as a function of time, has to be specifically adapted.

A variety of problems also arise depending on the liquids to be metered. For example, gas bubbles can form in the metering chamber that impair the conveying profile of the metering pump. If the gas content in the metering chamber increases too much, most metering pumps are no longer able to convey any fluid at all.

The displacement element can furthermore also get stuck in the metering head, as a result of which the displacement element carries out an altered movement or no movement at all, which likewise impairs the function of the metering pump. Other components of the metering pump that come into contact with the fluid to be conveyed, such as the fluid inlet or fluid outlet, can clog as well.

A variety of different solutions to solve these problems are known from the state of the art, but they require additional elements of the metering pumps. What is more, the solutions can often only address one of many problems.

The underlying object of the present invention is therefore to provide a method for moving a fluid or a corresponding metering pump with which a number of the aforementioned disadvantages are prevented without the need for additional components.

According to the present invention, this object is achieved by a method of the abovementioned type, wherein the movement of the displacement element in suction direction during the suction stroke involves at least two changes of direction before the displacement element reaches the second position and/or wherein the movement of the displacement element in pressure direction during the pressure stroke involves at least two changes of direction before the displacement element reaches the first position.

In other words, on its way from the first position to the second position during the suction stroke or on its way from the second position to the first position during the pressure stroke, the displacement element changes its direction of movement at least once before it changes direction again and again is moved in the original direction once more. The displacement element is thus not moved on a direct path to the target, but, before reaching the target position, which is the second position in the case of the suction stroke and the first position in the case of the pressure stroke, is instead moved again a short distance in the opposite direction to then ultimately reach the target position. The at least twofold change of direction can, however, also take place during the suction stroke and during the pressure stroke.

The movement of the displacement element is in particular linear. The change of direction of the displacement element is furthermore a 180° change of direction, i.e. the displacement element is moved only on a single line, whereby the direction of movement is periodically reversed. The suction direction is therefore understood to be the direction that connects the first position to the second position in a straight line, and the pressure direction is understood to be the direction that connects the second position to the first position on the same line.

By changing the direction of movement of the displacement element it is, for example, possible to achieve a venting of the metering chamber. The method according to the invention for controlling a metering pump reduces the formation of bubbles, because said bubbles experience a pressure pulse through the reversal of direction, which prevents adhesion of the gas bubbles to the metering chamber wall.

The method according to the invention furthermore also serves to clean the areas that come into contact with the fluid to be conveyed. Contaminants, for example in the fluid inlet or outlet, can be dislodged by briefly moving the displacement element back and forth and flushed out of the metering head.

For this purpose, in one embodiment, the movement of the displacement element specifically produces a movement of a valve closing body disposed in the fluid inlet or outlet. This targeted movement can be a single closing movement or an oscillation that continues for a specific period of time. The movement of the valve closing body allows contaminants such as crystals, salts or clumps to be dislodged mechanically from the valve seat. The targeted movement of the valve closing bodies can be so strong that cavitation symptoms occur as a result of the pressure waves in the fluid, i.e. gas bubbles form in the fluid inlet or outlet, which makes it possible to specifically affect the surface in the valve seat and achieve cleaning.

The speed of the fluid through the valve seat can alternatively or additionally also be increased by briefly accelerating the displacement element in order to dislodge contaminants with the fluid flow or pressure waves in the fluid.

In particular, in one embodiment, the method according to the invention is used for a cleaning cycle that takes place after a regular metering operation, i.e. a sequence of suction and/or pressure strokes without a change of direction. For this purpose, a valve closing body is specifically oscillated as described above.

The movement according to the invention of the displacement element can ultimately also be used to specifically affect the flow of the fluid or to specifically control valves.

In particular in the case of hydraulically driven metering pumps, the method according to the invention offers the advantage that different quantities of fluid can be conveyed without the need for a technical modification of the pump. Hydraulically driven metering pumps typically comprise so-called overflow and suction valves, via which hydraulic fluid is conveyed into or out of the hydraulic chamber which is separated from the metering chamber by the displacement element.

A hydraulically driven metering pump is typically operated in such a way that the quantity of hydraulic fluid in the hydraulic chamber is kept constant with the aid of a suction control. By specifically affecting the overflow and suction valves, however, the method according to the invention can be used to adapt the quantity of hydraulic fluid to the desired metering quantity.

Strong deceleration during the pressure stroke allows the suction valve to be opened, as a result of which hydraulic fluid is introduced into the hydraulic chamber and the membrane moves further in the direction of the first position, i.e. into the metering chamber. This reduces the dead space in the metering head and smaller quantities of fluid can be metered more easily and more accurately. It also makes it possible to achieve higher pressures during the pressure stroke.

Short pressure waves during the pressure stroke, on the other hand, can specifically open the overflow valve, as a result of which hydraulic fluid escapes from the hydraulic chamber. This causes the displacement element, typically a membrane, to assume a neutral position closer to the second position. There is a risk that the membrane will hit the hydraulic chamber, but the membrane hitting the hydraulic chamber lowers the pressure in the hydraulic chamber and the suction valve opens, which allows hydraulic fluid to flow back into the hydraulic chamber. The described process therefore enables a targeted exchange of the hydraulic fluid and also a venting of the hydraulic chamber.

At the same time, the method according to the invention offers the advantage that it can also be used to address a variety of measurement tasks.

For example, a sound test on the valves and the method according to the invention can be used to react to a changed fluid property, such as viscosity. For this purpose, a sound signal produced when the valve closing bodies hit the valve seat is recorded at regular intervals and compared to a target sound signal. The method according to the invention can alternatively also be used to excite the valve closing body in such a way that, as long as the fluid properties remain unchanged, the valve closing body hitting the valve seat always produces exactly the same sound signal. A different sound signal being produced when the excitation remains the same, conversely indicates a malfunction of the metering pump and an error message can be output to the user. Particularly preferably, however, the method according to the invention is also used to govern the movement of the displacement element in such a way that the measured sound signal is adapted to the target sound signal. The method according to the invention thus provides the ability to react automatically to changed fluid properties and keep the conveying profile of the metering pump constant.

It goes without saying that a measurement of the fluid properties, in particular the elasticity, and also a calibration, i.e. a compression check and corresponding stroke travel adjustment, can thus be carried out as well. Since the compressibility of fluids is a factor at very high pressures, depending on the fluid being conveyed, conventional metering pumps and conveying methods at high pressures have the disadvantage that the metered volume does not correspond to the displaced volume. In this case, we also speak of the effective stroke length of a metering pump, i.e. the stroke travel of the displacement element on which fluid is actually conveyed out of the metering chamber. The effective stroke length depends in particular on the fluid properties, the operating pressure and the temperature of the fluid. These parameters can change over the course of a conveying operation, and so can the effective stroke length and conveying volume. The method according to the invention provides the ability to react to such changes by first determining the fluid properties and then adapting the movement profile of the displacement element.

In one embodiment, the fluid properties are measured by measuring the pressure build-up as a function of the position of the displacement element. To do this, the increase in force can be measured directly at the drive, for example, or the signal of a pressure sensor at the metering head can be used. The pressure build-up is particularly preferably measured as a function of the position of the displacement element such that the generated pressure remains below a pressure that is ultimately necessary for conveying the fluid. This ensures that no fluid is lost during calibration.

Adapting the movement profile of the displacement element after the material properties are acquired then in turn has the advantage of enabling permanent and precise metering of the fluid.

In the case of pulsators, the method according to the invention can also be used to measure pulsation and accordingly optimise the metering profile.

In one embodiment, the displacement element is moved by means of a drive, wherein the drive is a linear motor. Linear motors in particular can be controlled as required, which makes it possible to implement a wide variety of movement profiles of the displacement element. Since linear motors can be controlled in very small steps, linear motors are also particularly suitable for metering very small quantities.

In another embodiment at least four, preferably at least six, changes of direction take place. The number of changes of direction depends in particular on the intended application. If the intent is to dislodge a displacement element, for example a membrane, that is stuck in the metering head, for example by cooled fluid residues, smaller oscillating movements exerted by the drive on the displacement element have in particular proven effective. These small oscillating movements gently and non-destructively dislodge the displacement element from its stuck position, and the pump can be taken back into operation without damage even after a prolonged shutdown.

In another embodiment, the displacement element is moved at a speed of at least 1 m/s. This speed ensures that the displacement element actually exerts the desired effect on the fluid to be conveyed and that the fluid to be conveyed follows the movement of the displacement element as closely as possible.

In another embodiment, the displacement element is periodically accelerated, preferably at the beginning or at the end of the suction or pressure stroke or before or after the change of direction of the movement, with an acceleration of at least 100 $m/s^2$ and at most 400 $m/s^2$. A corresponding acceleration at the beginning or at the end of the suction or pressure stroke causes the metering chamber to be emptied completely, for example. The acceleration of the displacement element also counteracts the formation of gas bubbles.

In another embodiment of the method according to the invention, the displacement element travels a distance x between the first position and the second position when the displacement element is moved without a change of direction from the first position to the second position, or vice versa, wherein the displacement element travels a distance $S=(1+2a)x$ when the movement of the displacement element in suction direction or pressure direction involves two changes of direction, wherein a is at least 0.1, and at most 0.9, preferably 0.5.

Therefore, the direction of movement opposite to the actual direction of movement of the displacement element does not take place over the entire distance x between the first and the second position, but amounts to only a portion of this distance. A distance $\delta x$, which results from the difference between the distance $(1+2a)x$ and the distance x, can be adapted to the respective application. As already stated above, an oscillating movement with a lower amplitude $\delta x$ is advantageous for dislodging the membrane, for example, whereas a longer movement of the displacement element in the opposite direction is advantageous for other applications.

The underlying object of the invention is also achieved by a metering pump of the type mentioned at the outset, whereby the control device is configured to carry out a method according to any one of the embodiments described above.

Here, too, the drive is preferably a linear motor. Such linear motors typically consist of a stationary element and a movable element, whereby the movable element of the linear motor is coupled to the displacement element such that a movement of the movable element leads directly to a movement of the displacement element.

In one embodiment, the movable element and the displacement element are integrally formed.

In another embodiment, the stroke length h of the movable element is at least 40 mm, preferably at least 50 mm. The relatively large stroke length enables multiple changes of direction of the displacement element to support the advantages of the method according to the invention described above.

In one embodiment, the displacement element is a membrane. If the displacement element is a membrane that separates the metering chamber from a hydraulic chamber, the method according to the invention allows the membrane to be dislodged if said membrane is stuck to one place in the metering head. Depending on the movement profile of the displacement element, it is also possible to carry out a membrane rupture test on the basis of the oscillating resonance or the sound characteristics of the membrane.

Membranes consisting of thin fabric and plastic layers, in particular, have to be dislodged very carefully to prevent damage to the membrane.

In another embodiment, the control device is further configured such that an acceleration of the movable element at the beginning of the forward and/or return stroke is greater than an acceleration of the movable element at the end of the forward and/or return stroke, or vice versa. As already described with regard to the method according to the invention, this has the advantage that the formation of gas bubbles and the incomplete emptying of the metering chamber during the pressure stroke and/or the suction stroke are prevented.

In another embodiment, the displacement element divides the metering head into the metering chamber and a hydraulic chamber, wherein the hydraulic chamber is or can be filled with a hydraulic fluid, wherein a stroke element is disposed in the hydraulic chamber and connected to the movable element such that a movement of the movable element during operation of the drive causes a force exerted by the stroke element on the hydraulic fluid to be transferred to the displacement element. In this case, therefore, neither the movable element nor the stroke element is directly mechanically connected to the displacement element; the force is instead transmitted on the basis of the compression of a hydraulic fluid.

Further advantages, features, and possible applications of the present invention will become apparent from the following description of an embodiment and the associated figures.

FIG. 1 shows a schematic illustration of a metering pump known from the state of the art.

Figure 2:
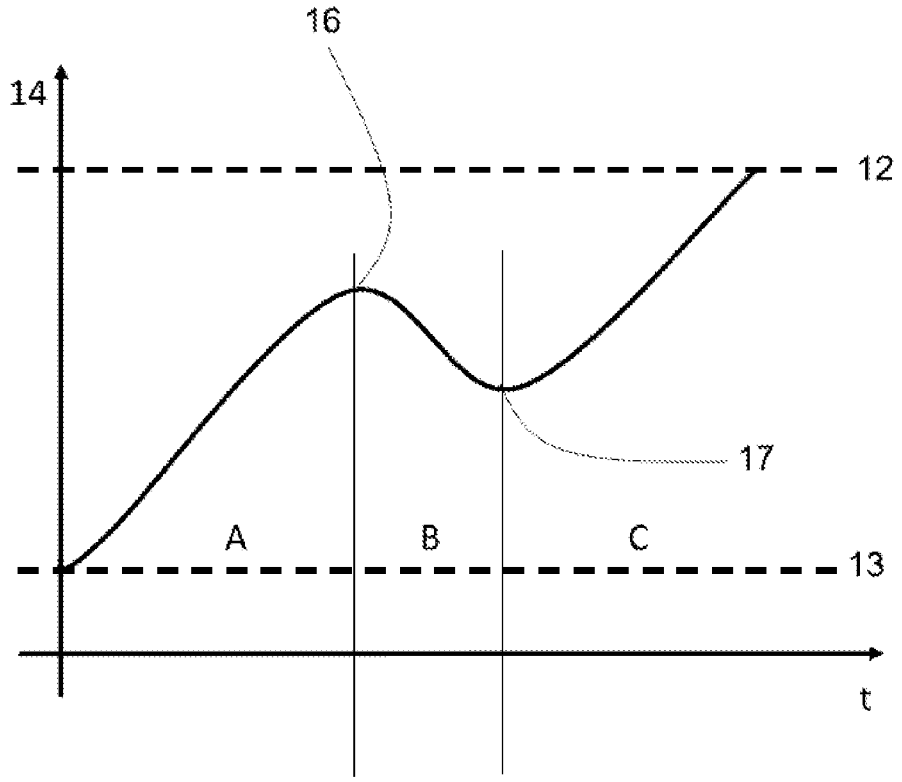

FIG. 2 schematically shows the position of the displacement element as a function of time for the method according to the invention during a pressure stroke.

Figure 3:
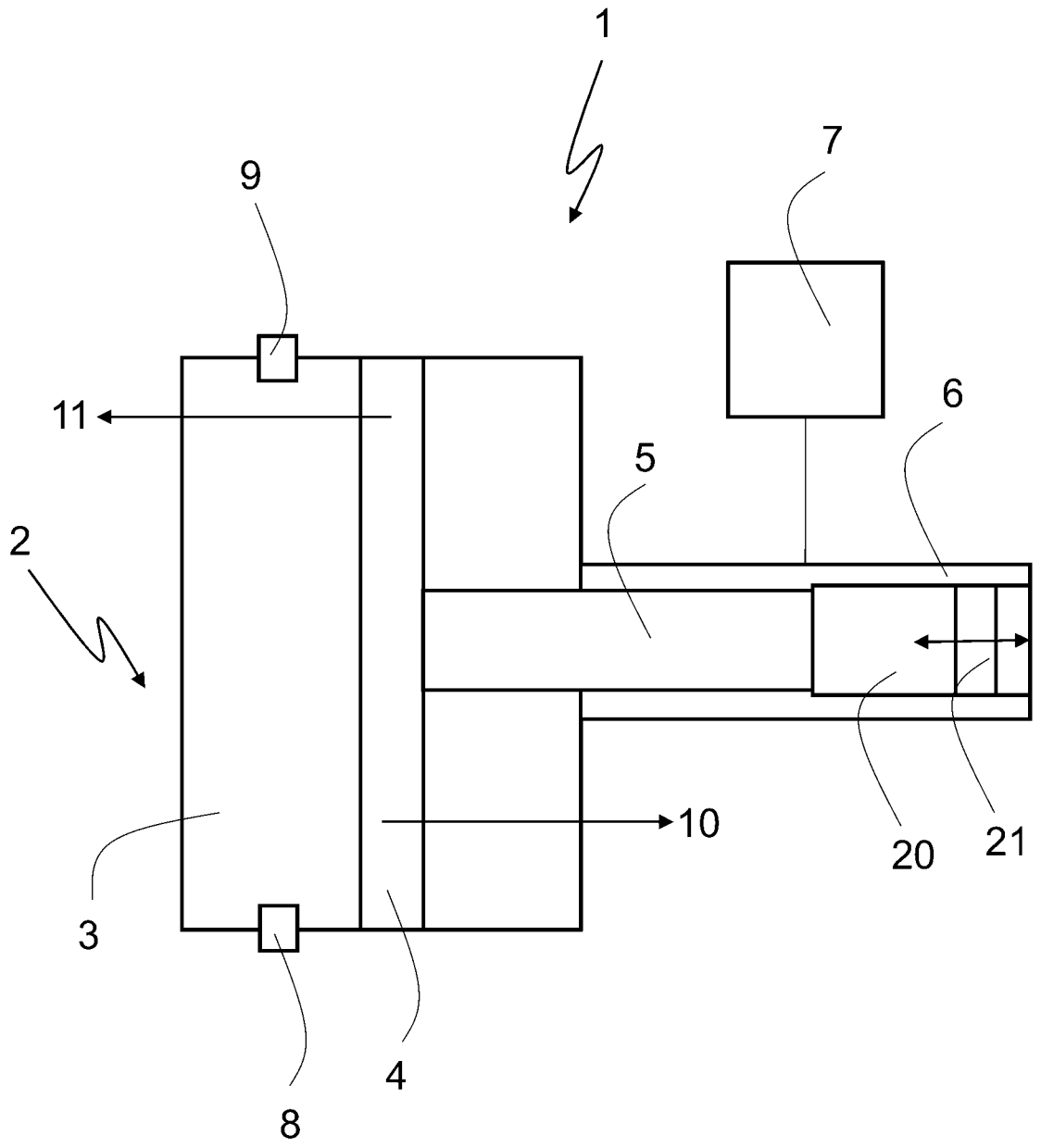

FIG. 3 is a schematic view of a metering pump according to the present invention, including a hydraulic chamber 20, a stroke element 21, and a movable element 5.

The metering pump 1 shown in FIG. 1 comprises a metering head 2, in which a metering chamber 3 and a displacement element 4 are disposed. The displacement element 4 can be moved back and forth between a first position 12 and a second position 13 (see FIG. 2) and delimits the metering chamber 3. When the displacement element 4 is moved back and forth between the first position 12 and the second position 13 with the aid of a movable element 5 of a drive 6, a volume of the metering chamber 3 changes and with it the pressure conditions inside the metering chamber 3.

When the displacement element 4 is moved from the first position 12 to the second position 13 during a suction stroke in suction direction 10, the volume of the metering chamber 3 increases, underpressure is created in the metering chamber 3 and fluid is drawn into the metering chamber 3 via a fluid inlet 8.

When the displacement element is moved from the second position 13 to the first position 12 during a pressure stroke in pressure direction 11, the volume of the metering chamber 3 decreases, overpressure is created and fluid is forced out of the metering chamber 3 via a fluid outlet 9.

The metering pump shown in FIG. 1 further comprises a control device 7 which controls the drive 6. According to the invention, the drive 6 is controlled by the control device 7 such that, during the pressure stroke, i.e. a movement from the second position 13 to the first position 12 in pressure direction 11, the displacement element 4 carries out two changes of direction 16, 17.

FIG. 2 shows the position 14 of the displacement element 4 as a function of time for the pressure stroke. In Section A, the displacement element 4 moves from the second position 13 in pressure direction 11 toward the first position 12. Before the displacement element 4 reaches the first position 12, however, a first change of direction 16 takes place so that the displacement element now periodically moves in the opposite direction, i.e. in suction direction 10 (Section B). A second change of direction 17 takes place at the end of Section B, so that the displacement element 4 moves in pressure direction 11 again until the displacement element 4 has reached the first position 12 (Section C).

LIST OF REFERENCE SIGNS

1 Metering pump
2 Metering head
3 Metering chamber
4 Displacement element
5 Movable element
6 Drive
7 Control device
8 Fluid inlet
9 Fluid outlet
10 Suction direction
11 Pressure direction
12 First position
13 Second position
14 Position of the displacement element
16 First change of direction
17 Second change of direction
20 hydraulic chamber
21 stroke element

The invention claimed is:

1. Method for moving a fluid comprising the steps of (a). providing a metering head (2) having a metering chamber (3) and a displacement element (4) which delimits said metering chamber (3), (b). moving the displacement element (4) in a suction direction (10) from a first position (12) to a second position (13), wherein a volume of the metering chamber (3) in the second position (13) of the displacement element (4) is greater than a volume of the metering chamber (3) in the first position (12) of the displacement element (4) such that fluid is drawn into the metering chamber (3) via a fluid inlet (8) during a suction stroke, (c). moving the displacement element (4) in a pressure direction (11) from the second position (13) to the first position (12) such that fluid is forced out of the metering chamber (3) via a fluid outlet (9) during a pressure stroke, characterized in that the movement of the displacement element (4) in pressure direction (11) during the pressure stroke involves at least two changes of direction (16, 17) before the displacement element (4) reaches the first position (12).

2. The method according to claim 1, wherein the displacement element (4) is moved by means of a drive (6), wherein the drive (6) is a linear motor.

3. The method according to claim 1, wherein the displacement element (4) is moved at a speed of at least 1 m/s.

4. The method according to claim 1, wherein the displacement element (4) travels a distance x between the first position (12) and the second position (13) when the displacement element (4) is moved without a change of direction from the first position (12) to the second position (13) or vice versa, wherein the displacement element (4) travels a distance (1+2a)x when the movement of the displacement element (4) in suction direction (10) or pressure direction (11) involves two changes of direction (16, 17), wherein a is at least 0.1.

5. The method according to claim 1, wherein the displacement element (4) is periodically accelerated with an acceleration of at least 100 $m/s^2$ and at most 400 $m/s^2$.

6. The method according to claim 5, wherein the displacement element (4) is periodically accelerated at the beginning or at the end of the suction or pressure stroke or before or after the change of direction of the movement.

7. Metering pump (1) for moving a fluid, comprising:

a metering head (2), a metering chamber (3) disposed in said metering head, and a displacement element (4) which can be moved back and forth between a first position (12) and a second position (13), wherein the displacement element (4) delimits the metering chamber (3), and a volume of the metering chamber (3) in the second position (13) of the displacement element (4) is greater than a volume of the metering chamber (3) in the first position (12) of the displacement element (4), wherein the displacement element (4) is coupled to a drive (6) via a movable element (5) such that, in an operation of the drive (6), in a housing, the movable element (5) carries out a forward stroke and a return stroke in the direction of an axis of movement having a stroke length h between a first end position and a second end position and the displacement element (4) is moved back and forth between the first position (12) and the second position (13), wherein the drive (6) further comprises a control device (7), characterised in that the control device (7) is configured to carry out a method according to claim 1.

8. The metering pump (1) according to claim 7, wherein the movable element (5) and the displacement element (4) are integrally formed.

9. The metering pump (1) according to claim 7, wherein the control device (7) is further configured such that an acceleration of the movable element (5) at the beginning of the forward and/or return stroke is greater than an acceleration of the movable element (5) at the end of the forward and/or return stroke, or vice versa.

10. The metering pump (1) according to claim 7, wherein the displacement element (4) divides the metering head (2) into the metering chamber (3) and a hydraulic chamber, wherein the hydraulic chamber is or can be filled with a hydraulic fluid, wherein a stroke element is disposed in the hydraulic chamber and connected to the movable element (5) such that a movement of the movable element (5) during operation of the drive (6) causes a force exerted by the stroke element on the hydraulic fluid to be transferred to the displacement element (4).

11. Method for moving a fluid comprising the steps of (a). providing a metering head (2) having a metering chamber (3) and a displacement element (4) which delimits said metering chamber (3), (b). moving the displacement element (4) in a suction direction (10) from a first position (12) to a second position (13), wherein a volume of the metering chamber (3) in the second position (13) of the displacement element (4) is greater than a volume of the metering chamber (3) in the first position (12) of the displacement element (4) such that fluid is drawn into the metering chamber (3) via a fluid inlet (8) during a suction stroke, (c). moving the displacement element (4) in a pressure direction (11) from the second position (13) to the first position (12) such that fluid is forced out of the metering chamber (3) via a fluid outlet (9) during a pressure stroke, characterized in that the movement of the displacement element (4) in suction direction (10) during the suction stroke involves at least two changes of direction (16, 17) before the displacement element (4) reaches the second position (13) and that the movement of the displacement element (4) in pressure direction (11) during the pressure stroke involves at least two changes of direction (16, 17) before the displacement element (4) reaches the first position (12).

12. The method according to claim 11 wherein the displacement element (4) is moved by means of a drive (6), wherein the drive (6) is a linear motor.

13. The method according to claim 11, wherein the displacement element (4) is moved at a speed of at least 1 m/s.

14. The method according to claim 11, wherein the displacement element (4) is periodically accelerated with an acceleration of at least 100 $m/s^2$ and at most 400 $m/s^2$.

15. The method according to claim 14, wherein the displacement element (4) is periodically accelerated at the beginning or at the end of the suction or pressure stroke or before or after the change of direction of the movement.

16. The method according to claim 11, wherein the displacement element (4) travels a distance x between the first position (12) and the second position (13) when the displacement element (4) is moved without a change of direction from the first position (12) to the second position (13) or vice versa, wherein the displacement element (4) travels a distance (1+2a)x when the movement of the displacement element (4) in suction direction (10) or pressure direction (11) involves two changes of direction (16, 17), wherein a is at least 0.1.

17. Metering pump (1) for moving a fluid, comprising:

a metering head (2), a metering chamber (3) disposed in said metering head, and a displacement element (4) which can be moved back and forth between a first position (12) and a second position (13), wherein the displacement element (4) delimits the metering chamber (3), and a volume of the metering chamber (3) in the second position (13) of the displacement element (4) is greater than a volume of the metering chamber (3) in the first position (12) of the displacement element (4), wherein the displacement element (4) is coupled to a drive (6) via a movable element (5) such that, in an operation of the drive (6), in a housing, the movable element (5) carries out a forward stroke and a return stroke in the direction of an axis of movement having a stroke length h between a first end position and a second end position and the displacement element (4) is moved back and forth between the first position (12) and the second position (13), wherein the drive (6) further comprises a control device (7), characterised in that the control device (7) is configured to carry out a method according to claim 11.

18. The metering pump (1) according to claim 17, wherein the movable element (5) and the displacement element (4) are integrally formed.

19. The metering pump (1) according to claim 17, wherein the control device (7) is further configured such that an acceleration of the movable element (5) at the beginning of the forward and/or return stroke is greater than an acceleration of the movable element (5) at the end of the forward and/or return stroke, or vice versa.

20. The metering pump (1) according to claim 17, wherein the displacement element (4) divides the metering head (2) into the metering chamber (3) and a hydraulic chamber, wherein the hydraulic chamber is or can be filled with a hydraulic fluid, wherein a stroke element is disposed in the hydraulic chamber and connected to the movable element (5) such that a movement of the movable element (5) during operation of the drive (6) causes a force exerted by the stroke element on the hydraulic fluid to be transferred to the displacement element (4).

* * * * *